United States Patent [19]

Deutsch et al.

[11] 4,194,426

[45] Mar. 25, 1980

[54] ECHO EFFECT CIRCUIT FOR AN ELECTRONIC MUSICAL INSTRUMENT

[75] Inventors: Ralph Deutsch; Leslie J. Deutsch, both of Sherman Oaks, Calif.

[73] Assignee: Kawai Musical Instrument Mfg. Co. Ltd., Hamamatsu, Japan

[21] Appl. No.: 885,552

[22] Filed: Mar. 13, 1978

[51] Int. Cl.[2] ..... G10H 1/02

[52] U.S. Cl. ..... 84/1.24; 84/1.26; 84/1.27; 84/DIG. 26

[58] Field of Search ..... 84/1.01, 1.24, 1.25, 84/1.26, 1.27, DIG. 26; 179/1 J

[56] References Cited

U.S. PATENT DOCUMENTS

| | | | |
|---|---|---|---|
| 3,610,805 | 10/1971 | Watson | 84/1.26 |
| 3,882,751 | 5/1975 | Tomisawa | 84/1.27 |
| 4,022,098 | 5/1977 | Deutsch | 84/1.01 |
| 4,079,650 | 3/1978 | Deutsch | 84/1.26 |
| 4,083,283 | 4/1978 | Hiyoshi | 84/1.24 |
| 4,085,644 | 4/1978 | Deutsch | 84/1.01 |
| 4,114,495 | 9/1978 | Tomisawa | 84/1.26 |
| 4,133,242 | 1/1979 | Nagai | 84/1.26 |
| 4,135,424 | 1/1979 | Okamoto | 84/1.26 |

*Primary Examiner*—J. V. Truhe
*Assistant Examiner*—William L. Feeney
*Attorney, Agent, or Firm*—Parker & Hale Christie

[57] ABSTRACT

An echo effect in a polyphonic digital tone synthesizer in which a musical tone is repeated at a controlled repetitive rate but decreasing peak amplitude when a key is depressed. The tone is repeated until the peak amplitude decays to a predetermined level regardless of when the key is released. If the key remains depressed, the peak amplitude decay recycles so that an echo effect will be repeated. The echo effect is obtained on a plurality of overlapping notes that need not be keyed in unison. The echo control includes an echo envelope register which stores a control word for each key that is depressed. The control word includes bits coded to identify the current amplitude of the echo decay envelope. The value of the control word is decremented at a control rate to provide a decaying echo amplitude. An echo delay register stores a control word for each key depressed, the control word being incremented at a controlled rate. When a control word in the echo delay register reaches a predetermined value, it causes the tone to be repeated regardless of the current status of the associated key. At the same time the control word is reset to start another timing cycle. The associated tone generator is released at the end of an echo tone when the echo envelope control word is decremented to a predetermined value and the key is released.

7 Claims, 2 Drawing Figures

ECHO EFFECT CIRCUIT FOR AN ELECTRONIC MUSICAL INSTRUMENT

FIELD OF THE INVENTION

This invention relates to polyphonic tone synthesizers, and more particularly, to a tone synthesizer having an echo effect.

BACKGROUND OF THE INVENTION

Various techniques have been used heretofore in obtaining an echo effect or reverberation in the tones generated by a musical instrument. In electronic organs and tone synthesizers of the analog type, echo effects have been produced by delay lines or by recording on endless tape loops using multiple read heads to reproduce the same tone at delayed intervals. Analog-type shift registers, sometimes referred to as "bucket brigade" devices (BBD), have also been used to generate multiple delayed tones which produce an echo effect. However, the BBD devices introduce undesirable bandwidth limitations which act to distort the echo tones.

SUMMARY OF THE INVENTION

The present invention is directed to an arrangement for producing an echo effect in digital tone generators, particularly of the polyphonic keyboard instrument described in copending application Ser. No. 603,776, filed Aug. 11, 1975, and issued as U.S. Pat. No. 4,085,644 entitled "Polyphonic Tone Synthesizer", by the same inventors as the present application. The polyphonic tone synthesizer is capable of generating a plurality of different tones simultaneously or in overlapping time relationship by depressing one or more keys on a conventional organ-type keyboard. The polyphonic tone synthesizer has a plurality of digital tone generators, an idle tone generator being assigned to a key when the key is operated. The generator, using a master data list defining the amplitudes of a series of sample points of the waveform of the desired tone, produces a musical tone having the fundamental pitch determined by the particular key that is operated. A number of different tones can be simultaneously generated up to the total number of tone generators in the system. The envelope waveshape of each tone is controlled by a time-shared ADSR generator of the type described in copending application Ser. No. 652,217, filed Jan, 26, 1976, issued as U.S. Pat. No. 4,079,650 entitled "ADSR Envelope Generator". The present invention provides an echo effect in which operation of a key causes the corresponding tone to be generated repetitively at controlled intervals with the peak amplitude of the envelope of each successive repeated tone decreasing in substantially exponential fashion. Thus the echo effect is synchronous with actuation but is independent of when the key is released. The timing between echos is controlled independently of the decay in the peak amplitude of the echo tones. The echo effect can be applied to a plurality of tones which are initiated at different times but which may overlap.

These and other advantages of the present invention are provided in a polyphonic tone synthesizer of the type having a keyboard in which one of a plurality of tone generators is assigned to a key when the key is depressed. The envelope shape of the tone is controlled by an ADSR generator. The echo effect is provided by an echo envelope register storing a control word for each of the tone generators and an echo delay register for storing a control word for each of the tone generators. When a key is depressed, the control words in these two registers associated with the assigned tone generator are initialized to a predetermined value. The control word in the echo envelope register is decremented periodically in synchronism with an echo delay clock, while the control word in the echo delay register is incremented periodically by an echo repeat clock. Whenever the control word associated with a particular tone, as stored in the echo delay register, reaches a predetermined value, generation of the tone is repeated. The peak amplitude of the envelope of the resulting pattern of tones is controlled by the value of the associated control word in the echo envelope register.

DESCRIPTION OF THE DRAWINGS

For a better understanding of the invention reference should be made to the accompanying drawing, wherein.

DETAILED DESCRIPTION

The preferred embodiment of the present invention is incorporated in a digital tone generator of the type described in copending application Ser. No. 603,776, filed Aug. 11, 1975, entitled "Polyphonic Tone Synthesizer" now issued as U.S. Pat. No. 4,085,644 and to related disclosures in U.S. Pat. No. 4,022, 098, entitled "Keyboard Switch Detect and Assignor", and application Ser. No. 652,217 filed June 26, 1976, entitled "ADSR Envelope Generator". The disclosures in these patents and patent application are hereby incorporated by reference in the present application.

Figure 1:
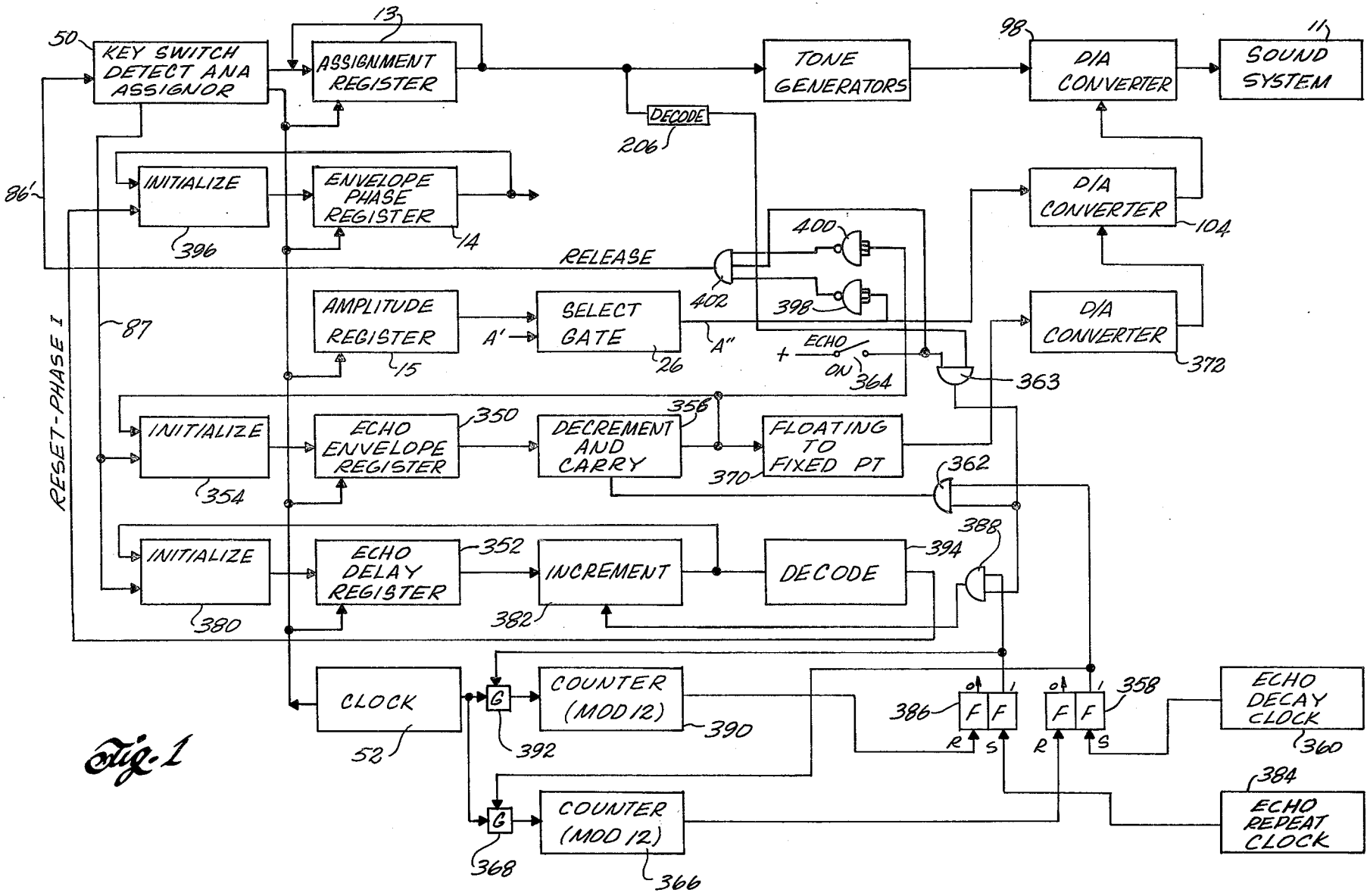
FIG. 1 is a schematic block diagram of the preferred embodiment of the present invention.
Figure 2:
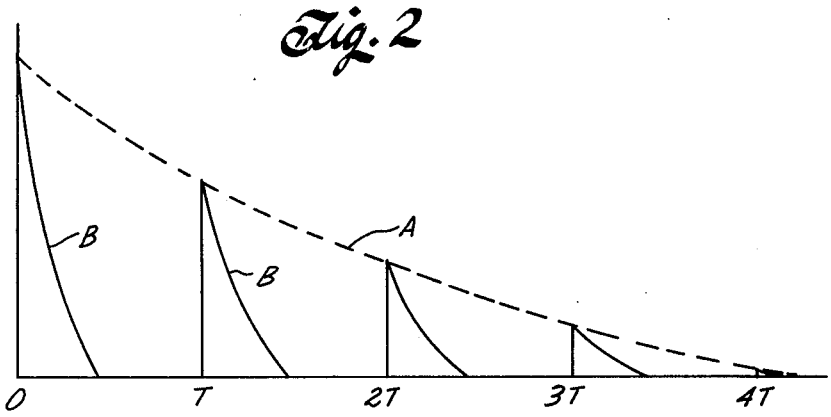
FIG. 2 shows a waveform useful in explaining the operation of the invention.

The echo effect circuit of the present invention generates tones having the envelope waveform shown in FIG. 2, for example. A tone having an envelope with a sharp attack and exponential decay is repeated periodically but with exponentially decreasing peak amplitude, as indicated by curve A. The circuit is shown by the block diagram of FIG. 1.

The polyphonic tone synthesizer is a keyboard type musical instrument capable of generating a plurality of tones simultaneously by depressing several keys. The number of notes that can be sounded at the same time is determined by the number of tone generators. When a key is depressed, the key switch detect and assignor circuit 50 stores information in one word in an assignment register 13 identifying the particular key and assigns a tone generator for generating the tone associated with that key. The register stores separate control words for each depressed key up to the number of separate tone generators in the polyphonic tone synthesizer, for example, twelve. Each control word in the assignment register 13 has bits defining the note in the scale, the octave, the division, and a bit indicating whether the control word has been assigned to a tone generator. The control words are continuously shifted out of the assignment register 13 and recirculated in the register in synchronism with shift pulses derived from a high-speed clock source 52.

The same clock supplies shift pulses to an Envelope Phase register 14, and an Amplitude register 15 which are part of the ADSR generator described in the above-identified copending application Ser. No. 652,217. The registers 14 and 15 also contain twelve control words which are synchronized with the control words in the Assignment register 13. The control words in the Amplitude register 15 define the current envelope amplitude of each of the tones being generated. The Envelope Phase register 14 identifies in which phase of the ADSR generator operation the respective notes are currently operating. Operation of the registers 14 and 15 may be controlled to generate any type of envelope shape for the tones being generated, but for the present echo effect are preferably controlled to provide a percussive type tone having the envelope waveshape shown in FIG. 2. The manner in which the ADSR generator, utilizing the registers 14 and 15, controls the amplitude waveshape is fully described in the above-identified copending application Ser. No. 652,217.

Whenever a key is actuated on the keyboard, the key switch detect and assignor circuit 50 generates a signal on a line 87 in the manner described in detail in the above-identified U.S. Pat. No. 4,022,098. In providing the echo effect of the present invention, this signal is used to initialize a control word in an echo envelope register 350 and an echo delay register 352. The registers 350 and 352, like the registers 13, 14, and 15, contain twelve control words, one for each tone generator. These control words are shifted and recirculated through the registers by clock pulses from the clock source 52 in synchronism with the shifting of the registers 13, 14, and 15. An initialize circuit 354 in response to the signal 87 sets the control word being circulated back to the input of the echo envelope register 350 to a predetermined maximum value. Each control word in the echo envelope register 350 is in floating point notation with three bits corresponding to the mantissa and three bits corresponding to the power of the floating point member. Initially all of the bits of the mantissa and the power are set to "1".

The control words from the echo envelope register 350 are shifted and recirculated through the decrement and carry circuit 356 which, when activated, reduces the mantissa of the current control word applied to the input by one unit. Every time the mantissa is counted down through zero, a carry pulse reduces the power bits by one unit. The decrement and carry circuit 356 is controlled by a flip-flop 358. The flip-flop 358 is set to the "1" state by clock pulses from an echo decay clock 360. If the flip-flop 350 is set to "1", the decrement and carry circuit 356 is activated in response to the output of an AND circuit 362. In addition to sensing that the flip-flop 358 is set, the AND circuit 362 senses that an Echo On switch 364 has been closed, and that the particular note identified by the output of the Assignment register 13 is a note on the particular keyboard that may be used for the echo effect as indicated by the output of an AND circuit 363. For example, where there is an upper division or keyboard, a lower division and a pedal division, only notes in the upper division normally are used for the echo effect. A decode circuit 206 determines when the note of an assigned tone generator corresponds to the upper division.

The decrement and carry circuit 356, once activated by the flip-flop 358, decrements each of the twelve control words in succession from the Echo Envelope register 350 by one, and then is deactivated until the next echo delay clock is generated. The flip-flop 358 is reset after twelve shift clocks from the clock source 52 by gating the clock pulses to a modulo 12 counter 366 through a gate 368. The gate is turned on by the setting of the control flip-flop 358. After twelve clock pulses have been gated to the counter 366 it generates an output pulse which resets the control flip-flop 358, terminating the decrementing of the Echo Envelope register control words until the next echo decay clock pulse is generated.

The output control words from the Echo Envelope register 350 are applied to a fixed point converter circuit 370 to produce an exponentially changing set of values which are applied to a digital-to-analog converter 372. This technique of converting linearly changing digital values in floating point notation to exponentially changing values in fixed point notation is described in detail in copending application Ser. No. 803,447, filed June 6, 1977, issued as U.S. Pat. No. 4,144,789 entitled "Amplitude Generator for an Electronic Organ" and assigned to the same assignee as the present application. Thus the digital-to-analog converter 372 produces an exponentially changing analog voltage at the output in which the rate of decay is determined by the frequency of the echo decay clock 360. By adjusting the frequency of the clock 360 the rate at which the echo envelope, indicated by the dotted curve A in FIG. 2, decays can be varied. It should also be noted that while each of the control words in the Echo Envelope register 350 are decremented once each clock pulse of the echo decay clock 360, the control words may be initialized at different times so that each tone represented by the control words in the register 350 may be in a different point along the decay curve A.

The control words in the echo delay register 352 determine the time value T between successive echo sounds of the tone being generated. An initialize circuit 380, in response to the signal on the line 87 from the key switch detect and assignor circuit 50, sets a control word to zero. The value of each control word in the echo delay register 352 is incremented periodically by an increment circuit 382 at time intervals controlled by an echo repeat clock 384. Each output pulse from the echo repeat clock 384 sets a control flip-flop 386, which in turn activates the increment circuit 382 through an AND circuit 388 when the echo switch 364 is closed and the note is one in which the echo effect is being generated. The control flip-flop 386 is reset by the output of a modulo 12 counter 390 after twelve clock pulses from the clock source 52 are gated to the counter 390. A gate 392 controlled by the flip-flop 386 gates the clock pulses from the source 52 to the counter 390. Thus with each pulse from the echo repeat clock 384, each of the control words in the echo delay register 352 is incremented by one. It should be noted that the echo repeat clock 384 is substantially slower than the clock source 52, thus insuring that the counter 390 is always counted to twelve before the next echo repeat clock 384 is generated.

After a control word in the echo delay register is incremented to a predetermined value, as determined by a decode circuit 394, the output of the decode circuit 394 activates an initialize circuit 396 for setting the associated control word in the envelope phase register 14 back to the phase one to reset the ADSR control. The envelope phase register 14 is part of the ADSR generator and controls the shape of the envelope of the tone being generated, as represented by curves B of FIG. 2. The ADSR generator is described in detail in the above-identified copending application Ser. No. 652,217. By resetting the associated control word in the Envelope Phase register 14 back to phase one, at time intervals T, the amplitude of the envelope of the successive echo tones is repeated. The envelope amplitude is controlled by the control words in the amplitude register 15 which are applied to a digital-to-analog converter 104 through a select gate 26, all in a manner described in the above-identified copending application Ser. No. 652,217. The output of the digital-to-analog converter 372 is used to control the output level of the digital-to-analog converter 104. Thus each successive echo tone generated is of reduced peak amplitude, as determined by the decay curve A of FIG. 2. The analog voltages corresponding to curves B of FIG. 2 are produced at the output of the digital-to-analog connverter 104 and applied to a digital-to-analog converter 98 to in turn control the peak amplitude of the audio signal applied to the sound system 11.

It should be noted that the control words in the echo delay register 352 are all incremented at the same rate as determined by the frequency of the echo repeat clock 384. Thus the echo repeat interval T is the same for all tones being generated. However, because a different control word is assigned to each tone being generated by the tone generators, the amplitude envelopes of the several echo tones need not be in phase.

The release of a note is made independent of the length of time that the musician actuates the key. Once a key has been actuated, the echo tones will continue to be generated until the peak amplitude of the echos decay substantially to zero. This is accomplished by a NAND gate 398 which senses when the output of the select gate 26 is zero. Similarly a NAND gate 400 senses when the output of the floating to fixed point circuit 370 is near zero (as by determining when all but the least significant bits are zero). An AND circuit 402 senses when both of these conditions are true and also that the Echo ON switch 364 is closed. The output of the AND circuit 402 provides a release signal on the line 86' back to the key switch detect and assignor circuit 50. If the corresponding key has been released by the musician, the key switch detect and assignor circuit will release the assigned tone generator in the manner described in connection with U.S. Pat. No. 4,022,098. If the key is still depressed when a release signal is received on the line 86', the key switch detect and assignor circuit 50 will cause a release but will immediately detect that the key is still actuated and accordingly will make a new key assignment on the same tone generator so that the echo tones will be repeated again as though the key had been released and reactivated by the musician.

What is claimed is:

1. In a polyphonic tone synthesizer of a type having a keyboard in which one of a plurality of tone generators is assigned to a key when the key is depressed for generating a musical tone having a pitch determined by the particular key, apparatus for producing an echo effect comprising:

an echo envelope register storing a control word for each tone generator, an echo delay register for storing a control word for each tone generator, means for initializing to a predetermined value the control words in the echo envelope register and the echo delay register associated with a particular tone generator when the tone generator is assigned to a depressed key, means including an echo decay clock for periodically changing the value of each of the control words in the echo envelope register at a first predetermined rate, means including an echo repeat clock for periodically changing the value of each of the control words in the echo delay register at a second predetermined rate, means responsive to each control word in the echo delay register for activating the associated tone generator to generate a tone of predetermined duration each time the associated control word in the echo delay register is changed by the echo repeat clock, and means responsive to each control word in the echo envelope register for controlling the peak amplitude of the successive tones generated by the associated tone generator.

2. Apparatus of claim 1 further including means sensing when a control word in the echo envelope generator reaches a predetermined value for releasing the associated tone generator from the assigned key.

3. Apparatus of claim 1 wherein said means controlling the peak amplitude of the successive tones includes means changing the peak amplitude of the successive tones substantially exponentially.

4. Apparatus of claim 1 wherein the control words in the echo envelope register are stored in digitally coded form, and said means controlling the peak amplitudes of successive tones includes a digital-to-analog converter for converting each control word to an analog signal.

5. In a polyphonic digital tone synthesizer in which a plurality of different tones may be generated simultaneously using a plurality of digital tone generators in response to activating a corresponding number of keys on a keyboard, each key when depressed generating and storing a separate control word in the register means having bits identifying the particular key, each control word being assigned to a tone generator when the particular key is depressed for controlling the pitch of the tone generated by the tone generator in response to the bits identifying the key, apparatus comprising means including an echo repeat clock for pulsing the output of the tone generated by the tone generator in response to activation of a key at the repetition rate of the repeat clock, means responsive to actuation of a key for setting a group of bits in the control word associated with the particular key in the register means to an initial value, means for periodically decrementing the value of said group of bits in the control words in the register means, and amplitude control means responsive to said group of bits in the control words for controlling the peak amplitude of the pulsed tone generated by the tone generator, said means reducing the amplitude as the value of said group of bits is decremented.

6. Apparatus of claim 5 wherein said amplitude control means includes a digital-to-analog converter for converting the value of said group of bits to an analog signal, and means responsive to said analog signal for attenuating the pulsed tone from the assigned tone generator in proportion to the magnitude of the analog signal.

7. Apparatus of claim 5 wherein decrementing means includes a clock for controlling the decrementing frequency of the value of said group of bits.

* * * * *